US008464878B2

(12) United States Patent
Andersen et al.

(10) Patent No.: US 8,464,878 B2
(45) Date of Patent: Jun. 18, 2013

(54) SHELVING SECTION PIVOTABLE BETWEEN A DISPLAY AND A REFILL POSITION

(75) Inventors: John Andersen, Fredrikstad (NO); Håkan Sjölander, Bräcke (SE)

(73) Assignee: Enjoy Group AB, Bracke (SE)

( * ) Notice: Subject to any disclaimer, the term of this patent is extended or adjusted under 35 U.S.C. 154(b) by 535 days.

(21) Appl. No.: 12/446,292

(22) PCT Filed: Oct. 19, 2007

(86) PCT No.: PCT/SE2007/000926

§ 371 (c)(1),
(2), (4) Date: Jun. 9, 2009

(87) PCT Pub. No.: WO2008/048172

PCT Pub. Date: Apr. 24, 2008

(65) Prior Publication Data

US 2010/0140201 A1 Jun. 10, 2010

(30) Foreign Application Priority Data

Oct. 20, 2006 (SE) ..... 0602242

(51) Int. Cl.
*A47F 5/08* (2006.01)

(52) U.S. Cl.
USPC ..... 211/150

(58) Field of Classification Search
USPC ..... 211/150, 151, 59.2, 126.15, 144; 108/92, 108/99, 6; 414/276
See application file for complete search history.

(56) References Cited

U.S. PATENT DOCUMENTS

| | | | | | |
|---|---|---|---|---|---|
| 794,809 | A | * | 7/1905 | Marsh | 108/143 |
| 844,915 | A | * | 2/1907 | Boole et al. | 105/160.5 |
| 905,452 | A | * | 12/1908 | Peters | 312/127 |
| 2,817,444 | A | * | 12/1957 | Brandell | 211/150 |
| 3,006,710 | A | * | 10/1961 | Petkwitz | 312/311 |
| 3,111,915 | A | * | 11/1963 | Gray | 108/6 |
| 3,172,715 | A | * | 3/1965 | Powder | 312/298 |
| 3,465,894 | A | * | 9/1969 | Setecka | 211/126.15 |

(Continued)

FOREIGN PATENT DOCUMENTS

| | | | |
|---|---|---|---|
| GB | 846454 | A | 8/1960 |
| JP | 2000-236969 | A | 9/2000 |
| WO | WO-2006/135305 | A1 | 6/2006 |

OTHER PUBLICATIONS

Office Action for European Application No. 07835127.7, dated Oct. 17, 2012.

*Primary Examiner* — Darnell Jayne
*Assistant Examiner* — Patrick Hawn
(74) *Attorney, Agent, or Firm* — Birch, Stewart, Kolasch & Birch, LLP

(57) ABSTRACT

The present invention relates to a shelf assembly for products, comprising a shelving section (103) which has a plurality of gravity-feeding shelves (111) and a base plate (105), the underside of which is provided with roller means (117), which are adapted to roll on a base; and a position-fixing means (107) which extends along the base and which is arranged to engage the base. The shelving section (103) is pivotally connected (123) to the position-fixing means (107) and is pivotable between at least one display position, in which the shelves are accessible from the front of the shelving section, and a refill position, in which the shelves are accessible from the rear of the shelving section.

8 Claims, 9 Drawing Sheets

U.S. PATENT DOCUMENTS 3,700,114 A * 10/1972 Myers ..... 211/150
3,981,511 A * 9/1976 Foster ..... 280/79.3
4,067,265 A * 1/1978 Watson ..... 108/7
5,170,896 A * 12/1992 Konstant ..... 211/151
5,205,419 A * 4/1993 Purtilo ..... 211/41.8
5,222,607 A * 6/1993 Collins ..... 211/41.12
5,224,611 A 7/1993 Phillipson et al.
5,419,444 A * 5/1995 Strom ..... 211/151
5,816,419 A * 10/1998 Lamson ..... 211/150
5,848,713 A * 12/1998 Allen ..... 211/151
6,648,573 B1 * 11/2003 Davison ..... 414/276
7,780,019 B2 * 8/2010 Konstant ..... 211/151
2002/0023889 A1 * 2/2002 Larbaletier ..... 211/150
2004/0211741 A1 10/2004 Bustos et al.
2006/0163984 A1 7/2006 Andersen
2006/0231517 A1 * 10/2006 Bothun et al. ..... 211/151
2006/0243690 A1 * 11/2006 Mollard ..... 211/151
2007/0035219 A1 * 2/2007 Andersen et al. ..... 312/249.9
2007/0145869 A1 * 6/2007 Sjolander et al. ..... 312/249.8
2007/0295682 A1 * 12/2007 Konstant ..... 211/151
2010/0012608 A1 * 1/2010 Stolzer et al. ..... 211/151
2010/0140201 A1 * 6/2010 Andersen et al. ..... 211/150
2010/0176074 A1 * 7/2010 Andersen et al. ..... 211/59.2

* cited by examiner

SHELVING SECTION PIVOTABLE BETWEEN A DISPLAY AND A REFILL POSITION

FIELD OF THE INVENTION

The present invention relates generally to a shelf assembly for products and, more specifically, to a shelf assembly with gravity-feeding shelves, which shelf assembly is pivotable between at least one display position, in which the shelves are accessible from the front of the shelving section, and a refill position, in which the shelves are accessible from the rear of the shelving section.

BACKGROUND ART

In supermarkets and department stores there are many different types of shelf assemblies, which are filled with products offered for sale. Many of these products must for various reasons, such as open-dating or refrigerating reasons, be supplied in such a manner that the last supplied products are positioned in the rear part of the shelf. At the same time this satisfies the requirement that the product first supplied is also first sold. A large amount of the time of the shop staff is used to supply additional products. This means that there is a great interest in getting rid of conventional types of shelf assembly where the remaining products from previous supplies first must be removed from the shelf assemblies before supplying new products. One way of solving this problem is to design shelf assemblies which are adapted to be refilled from behind. This can be achieved by wheels being mounted on the shelf assemblies so that the shelf assembly is completely pulled out, or alternatively pivoted out, from its position to make the rear accessible for refilling. Since the shelf assemblies are in many cases quite heavy and difficult to steer, it may be necessary to take care of this by using supports and/or guide tracks which guide the movement, like in shelf assemblies in refrigerators according to European patent application 1683449 A1.

This known variant is specifically intended for a refrigerator which has an outer cabinet, to which the shelf assembly is connected. However, there are many spaces, such as shops and cold-storage rooms, where there is no need for an outer cabinet.

US patent application 2004/0211741 discloses a shelf assembly which is arranged to be refilled from behind. A variant of this prior art shelf assembly is directly pivotable on a hinge which is attached to a corner post and which in turn is fixed to another shelf assembly which is positioned behind or beside the pivotable shelf assembly. A further variant can be pulled out forward and then be pivoted in the pulled-out position. In this variant, the shelf assembly is also connected to at least one neighbouring shelf assembly. The reason why a plurality of shelf assemblies are connected to each other in this manner is that one shelf assembly supports the others during said movements.

SUMMARY OF THE INVENTION

An object of the present invention is to provide a shelf assembly which is not dependent on connection to an outer cabinet or another shelf assembly but nevertheless has a controlled motion between the display position and the refill position and benefits from the associated advantages.

The object is achieved by a shelf assembly according to the invention as defined in the appended claims.

According to one aspect of the invention, a shelf assembly for products thus is provided, comprising a shelving section which has a plurality of gravity-feeding shelves and a base plate, the underside of which is provided with roller means, which are adapted to roll on a base; and a position-fixing means which extends along the base and which is arranged to engage the base and is provided with a high friction material on its side facing the base, the shelving section being pivotally connected to the position-fixing means and being pivotable between at least one display position, in which the shelves are accessible from the front of the shelving section, and a refill position, in which the shelves are accessible from the rear of the shelving section.

With the simple position-fixing means, the shelving section is kept in a predetermined display position. The shelving section is from there pivotable relative to said means to the refill position where the products can conveniently be supplied from behind, thereby automatically being positioned in the proper order. After refilling, the shelving section is pivoted back to the display position. The high friction material provides frictional engagement with the base. The thus achieved frictional engagement can be used as a single engagement, which is advantageous since this prevents damage to surface layers on, for instance, floors.

In one embodiment of the shelf assembly, the shelving section is provided with a first connecting means and the position-fixing means is provided with a second, complementary connecting means. The connecting means are pivotally connected to each other, and at least one of the connecting means is provided with a weight-distributing means for adjusting how much of the weight of the shelving section acts on the connecting means. In this embodiment, it is defined that some of the weight of the shelving section is placed on the connecting means and thereby presses the position-fixing means against the base and increases the fixing to the base. A construction alternative which results in the weigh-distributing possibility is a height-adjusting means.

In one embodiment of the shelf assembly, also the roller means are vertically adjustable. This allows not only adjustment to uneven bases but also a further possibility of distributing the weight of the shelving section on the roller means and the connecting means.

In one embodiment of the shelf assembly, the position-fixing means has connecting portions for connection to other position-fixing means. A plurality of shelf assemblies can advantageously be connected to a shelf arrangement, thus also increasing the position fixing.

According to another aspect of the invention, a shelf assembly for products is provided, comprising a shelving section which has a plurality of gravity-feeding shelves and a base plate, the underside of which is provided with roller means, which are adapted to roll on a base; and a position-fixing means which extends along the base and which is arranged to engage the base;

the shelving section having a front and a rear, a first and a second end wall, and front and rear corners respectively, the shelving section being pivotally connected to the position-fixing means at the one of the front corners which is located adjacent to the first end wall, and being pivotable between at least one display position, in which the shelves are accessible from the front of the shelving section, and a refill position, in which the shelves are accessible from the rear of the shelving section, the shelving section being designed so as to be pivotable also when the shelf assembly is positioned between two other, neighbouring shelf assemblies, by the rear corner located adjacent to the second end wall being positioned closer to the centre of the shelving section than the front corner located adjacent to the same end wall.

The shelf assembly according to this aspect of the invention makes it possible to achieve the same objects as does the shelf assembly according to the first aspect. In this case, frictional engagement with the base is not necessary, but some other engagement, such as fixed securing to the base, is conceivable. On the other hand, the second aspect allows pivotability about a front corner and a retracted rear corner which in cooperation, in contrast to the prior art shelf assemblies of the above-mentioned US patent application, make it possible to pivot the shelf assembly to the refill position even if it is positioned between two other shelf assemblies. As a result, a plurality of shelf assemblies can be arranged side by side in a row and still be individually operable to be refilled from behind.

BRIEF DESCRIPTION OF THE DRAWINGS

The invention will now be described in more detail by way of non-limiting embodiments and with reference to the accompanying drawing, in which

FIG. 7 is an enlargement of a detail;

DETAILED DESCRIPTION OF EMBODIMENTS

Figure 1:
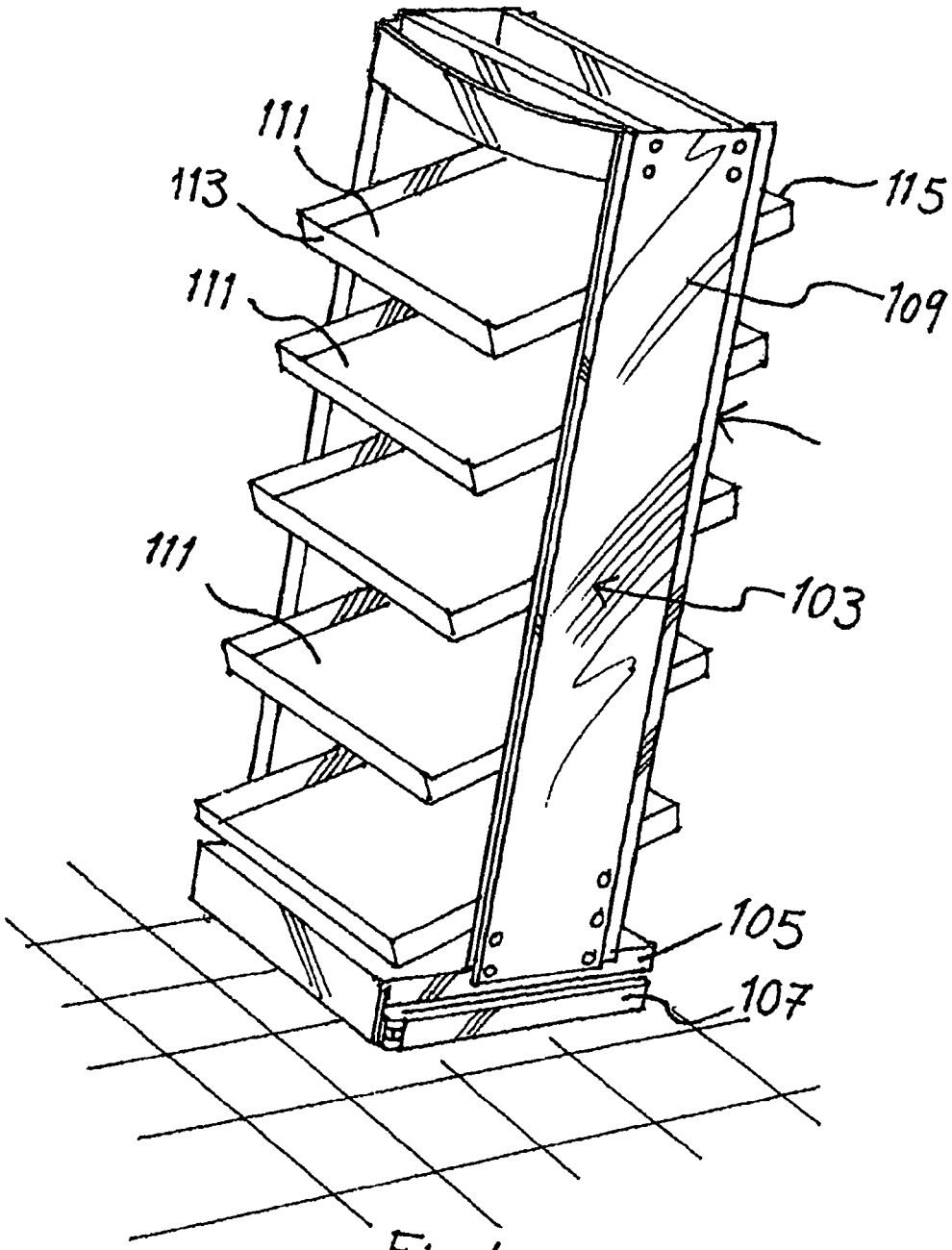
FIG. 1 is a perspective view of an embodiment of a shelf assembly according to the invention.
Figure 2:
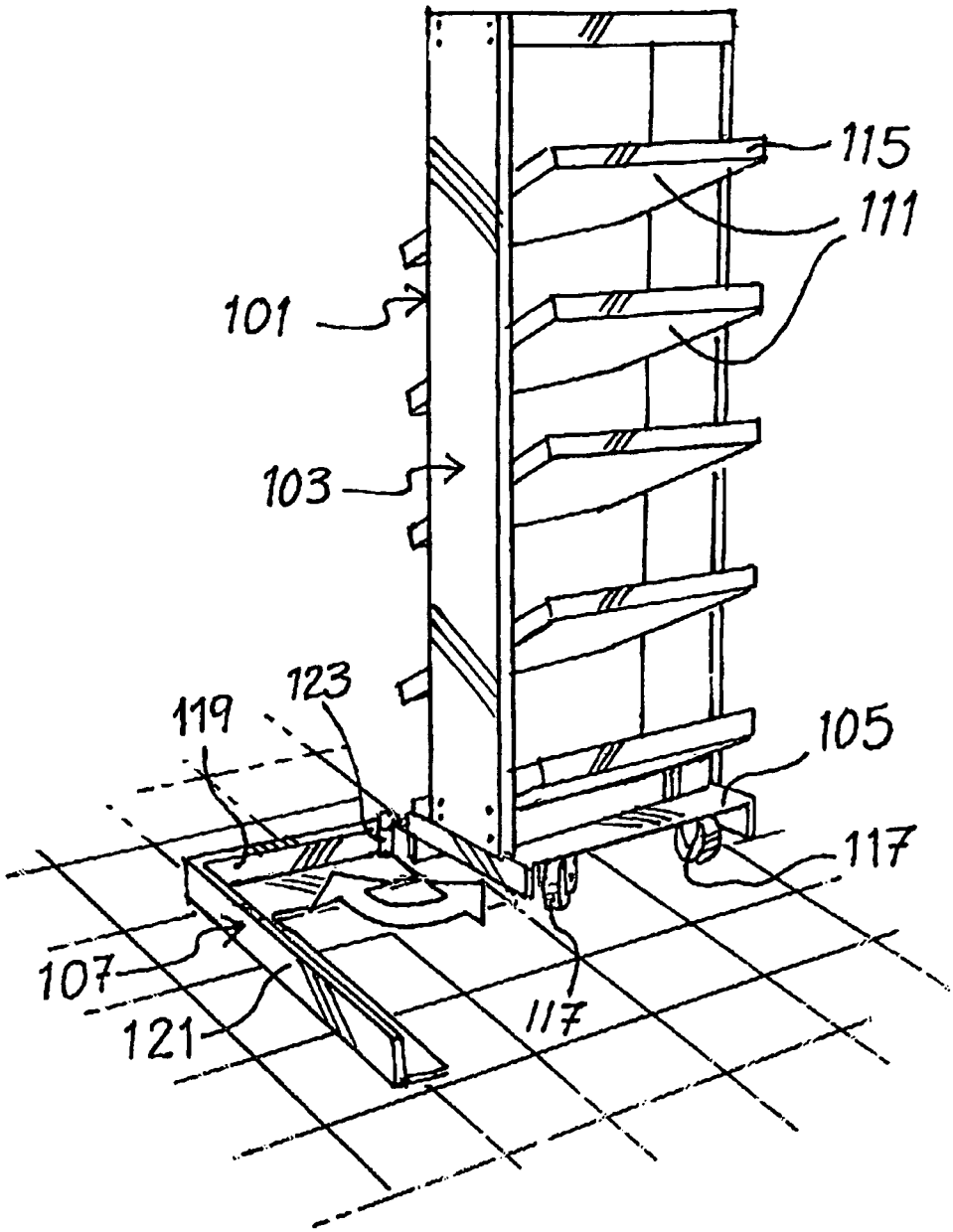
FIG. 2 is a perspective view which illustrates the shelf assembly in FIG. 1 pivoted to a refill position.
Figure 3:
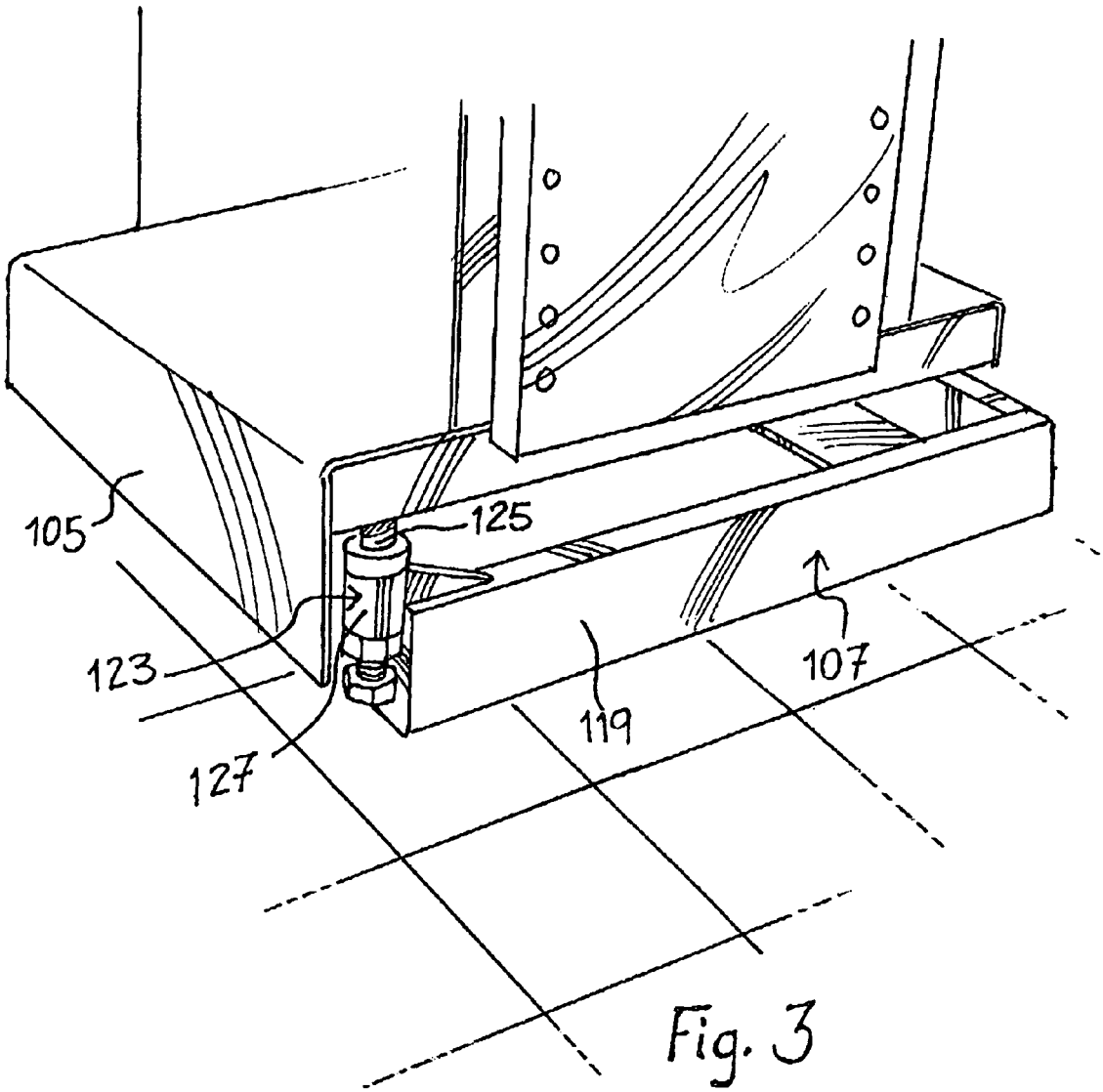
FIG. 3 is a perspective view which illustrates a lower part of the shelf assembly in FIG. 1.

An embodiment of a shelf assembly 101 according to the invention comprises a shelving section 103 which has a base plate 105 and a plurality of gravity-feeding shelves 111, which are releasably supported by opposite side walls 109. The base plate 105 is on its underside provided with roller means 117, which in this embodiment are wheels, which are adapted to roll on a base, usually a floor. The shelf assembly 101 further comprises an elongate, position-fixing means 107, which is arranged to abut against the floor, more specifically rest on the floor. The shelving section 103 is pivotally connected to the position-fixing means 107 by a pivot means 123 and is pivotable between at least one display position, which is shown in FIG. 1, in which the shelves 111 are accessible from the front 113 of the shelving section 103, and a refill position, which is shown in FIG. 2, in which the shelves 111 are accessible from the rear 115 of the shelving section 103.

The position-fixing means 107, which in the following will be referred to as floor frame, is provided with a high friction material 129 on its underside, see FIG. 4, which holds the floor frame 107 in place during pivoting of the shelving section back and forth, or out and in, between the positions. As a result, the floor frame 107 ensures that the shelf assembly 101 is not displaced but always takes its original position when returned to the display position from the refill position. The high friction materials may be, for instance, a rubber tape of soft rubber, or even a double-stick tape. However, no real attachment of the floor frame 107 to the floor is required. The floor frame 107 is L-shaped and has a first leg, or end wall leg, 119 and, connected at right angles to the same, a second leg, or rear leg 121. The pivot means 123 is arranged at the free end of the end wall leg 119. The end wall leg 119 is shorter than the rear leg 121. It should, however, be noted that the lengths of the legs are preferably selected according to the width and depth of the shelving section, and can thus be of the same length, in a square shelving section, or that the end wall leg 119 could be longer than the second leg 121.

Figure 7:
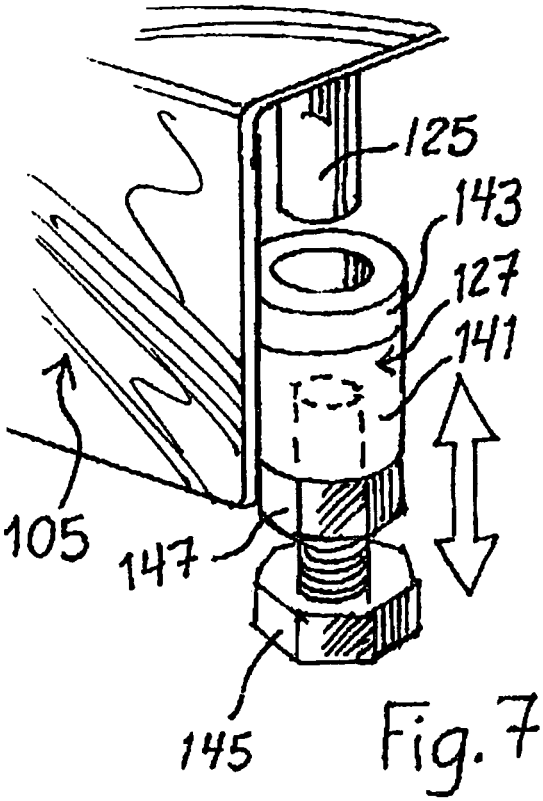

In addition, the friction on the base is increased by some of the weight of the shelving section 103 resting on the floor frame 107 as follows. The base plate 105 is provided with a first connecting means 125 and the floor frame 107 is provided with a secondary, complementary connecting means 127. The connecting means are pivotally connected to each other and form the above-mentioned pivot means 123. The second connecting means is provided with a weight-distributing means, see FIG. 7, for adjusting how much of the weight of the shelving section 103 acts on the connecting means 125, 127. More specifically, the second connecting means 127 comprises a sleeve 141 which is fixedly mounted at the free end of the end wall leg 119, a bearing 143 fixedly mounted on top of the sleeve 141, a nut 147 fixedly mounted at the lower end of the sleeve, and an adjusting screw 145 which is screw into and vertically adjustable in the nut 147. The first connecting means 125 is a pin which is lowered through the bearing 143 into the sleeve 143 and rests on the end of the screw 145. By screwing the screw into the sleeve 141 or unscrewing it therefrom, the pin 125 is raised or lowered, and thus also the corner of the base plate 105 where the pin 125 is placed will be raised or lowered. As a result, a greater or smaller amount of the weight of the shelving section 105 is taken up by the second connecting means 127, and thus by the floor frame 107. Each leg is L-shaped insofar as it has a horizontal beam which is slightly higher than it is wide and a support plate 131 which is connected to the beam and which extends from the beam and under the base plate 105, at the lower edge of the beam.

Also the wheels 117 are vertically adjustable by means of adjusting screws 139, which at the same time are fixing screws for the attachment of the wheels to the main portion of the base plate 105. At the end walls of the base plate 105 there are upwardly extending fastening plates 137 for fastening of the side walls 109.

Figure 4:
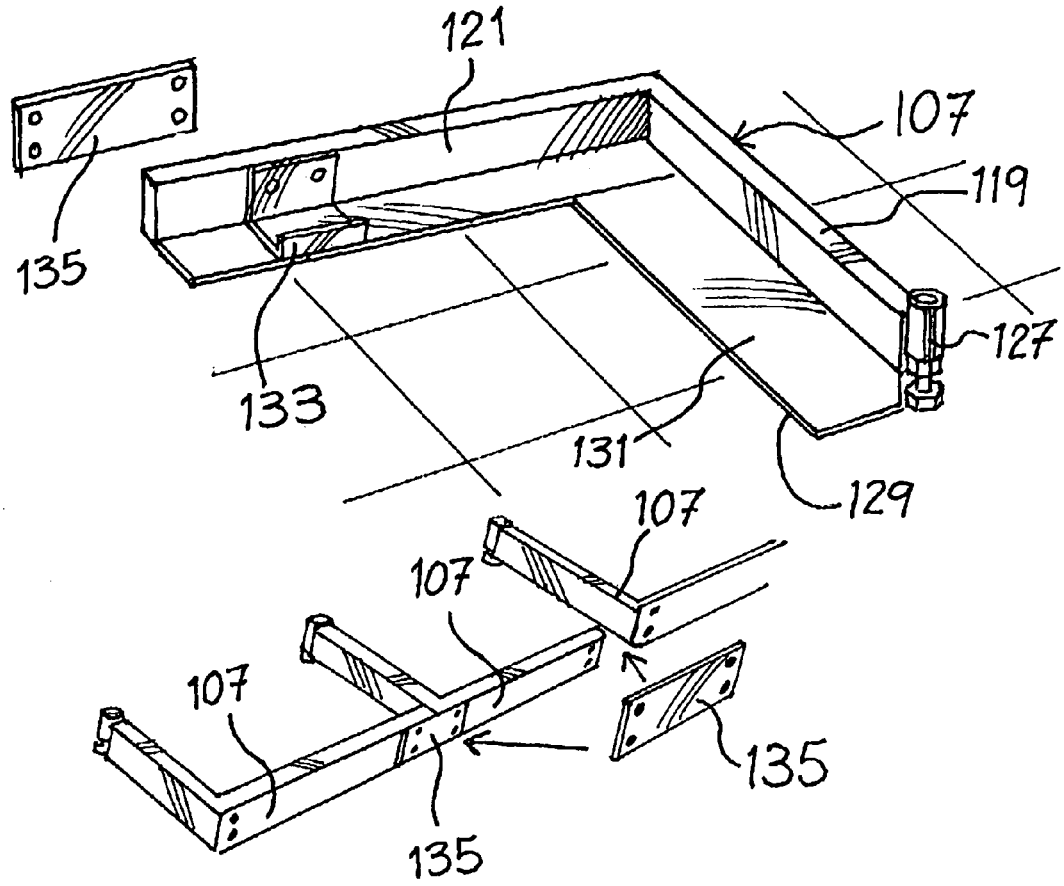
FIGS. 4-8 are perspective views which illustrate parts included in the shelf assembly according to the FIG. 1, where

A plurality of shelf assemblies 101 can be arranged side by side and their floor frames can be interconnected, in the way as illustrated in FIG. 4. Thus, the rear leg 121 of each floor frame 107 has fixing points at both of its ends. A connecting means 135 connects two neighbouring floor frames 107 to each other. It is also possible to interconnect two shelf assemblies which are arranged back-to-back via the floor frames.

Figure 5:
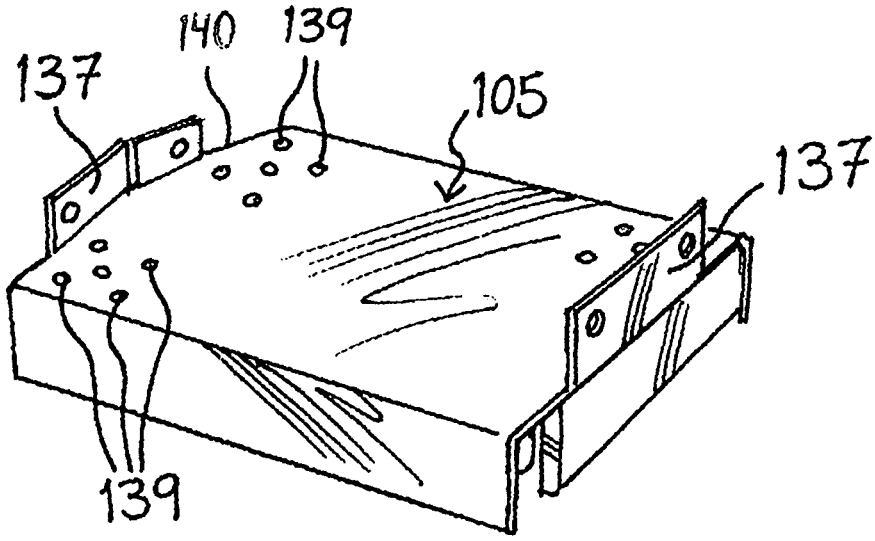
Figure 6:
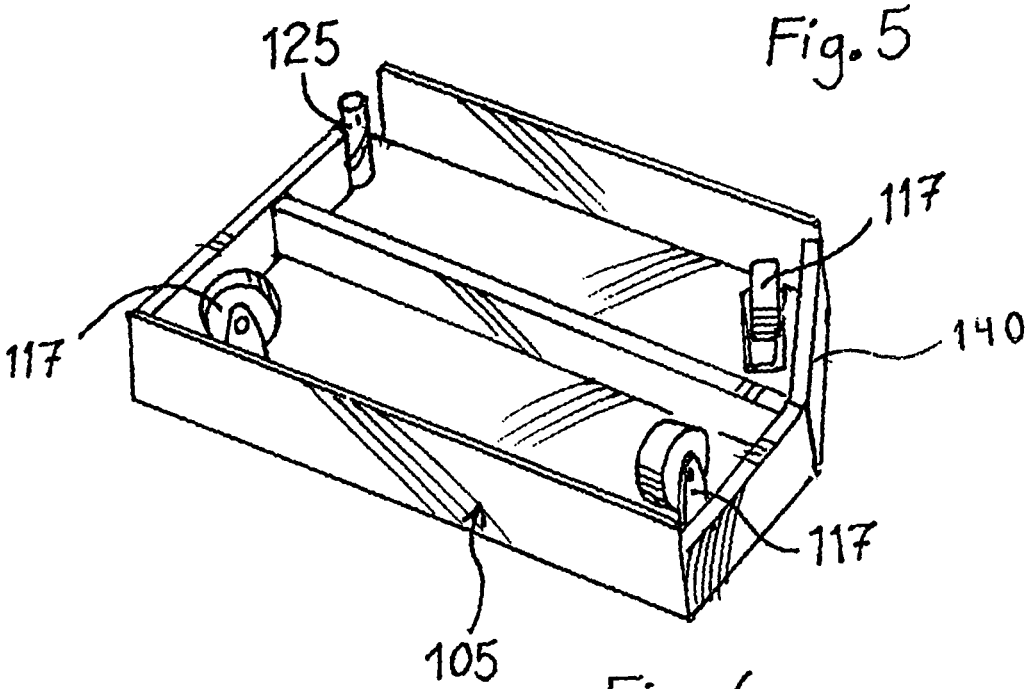

As shown in FIGS. 5 and 6, with the reference numeral 140, it is possible to arrange a plurality of shelf assemblies side by side and fairly close to each other if one corner is rounded, for instance bevelled. More specifically, this applies to the corner at the rear of the shelving section which is located adjacent to the end wall opposite the end wall at which the pivot means 123 is placed. The rounding decreases the pivoting radius. When the shelving section 103 is pivoted out from the display position, the corner would otherwise bump into the neighbouring shelf assembly 101.

Figure 9:
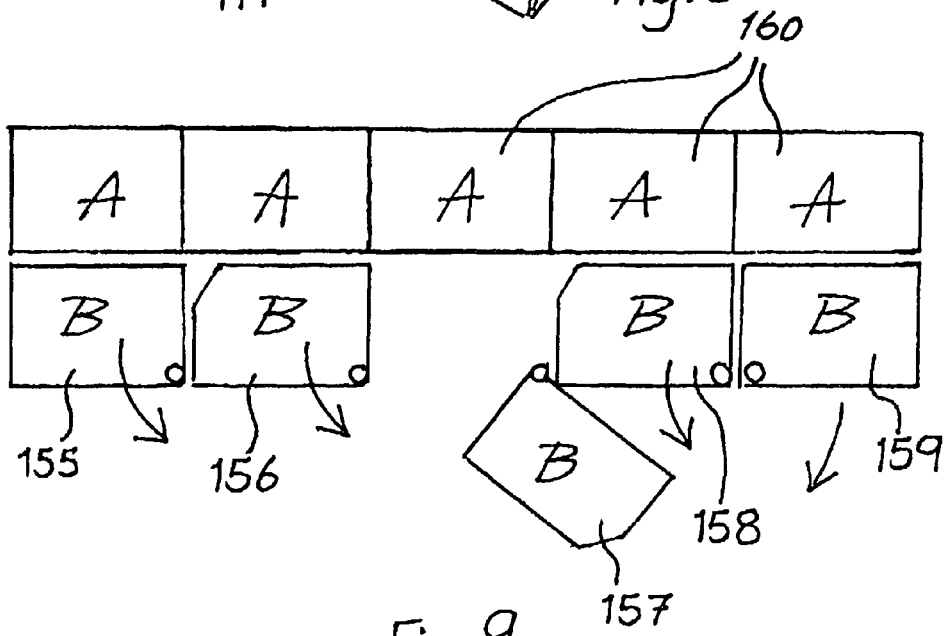
FIG. 9 shows an example of a shelf system with a plurality of shelf assemblies in different designs.

FIG. 9 shows a shelving system with a row of six fixed shelf assemblies 160 which are arranged side by side. Six shelf assemblies 155-159 according to the invention are arranged side by side, their backs facing the backs of the fixed shelf assemblies 160. The shelf assembly at the extreme left 155 has its pivot means arranged at the front right corner and can thus be pivoted outward freely and independently of the other shelf assemblies 156-159. Also the other shelf assemblies 156-158, except the shelf assembly 159 at the extreme right, have their pivot means at their front right corner. The shelf assembly 159 at the extreme right has its pivot means at its front left corner and can thus also be pivoted freely. In each of the three intermediate shelf assemblies 156-158, the rear left corner is rounded to allow the pivoting motion. The shelf surface lost by this rounding-off is, however, marginal. When a shelf assembly 101 is pivoted out to the refill position, not only its own rear will be accessible for supplying products from behind, but also the rear of the neighbouring fixed shelf assembly 160. Provided that both shelf assemblies allow refilling from behind, two shelf assemblies can thus be refilled at the same time in a comfortable and correct manner by a single shelf assembly being pivoted outward. The fixed shelf assemblies may, of course, instead be shelf assemblies according to the invention.

Figure 8:
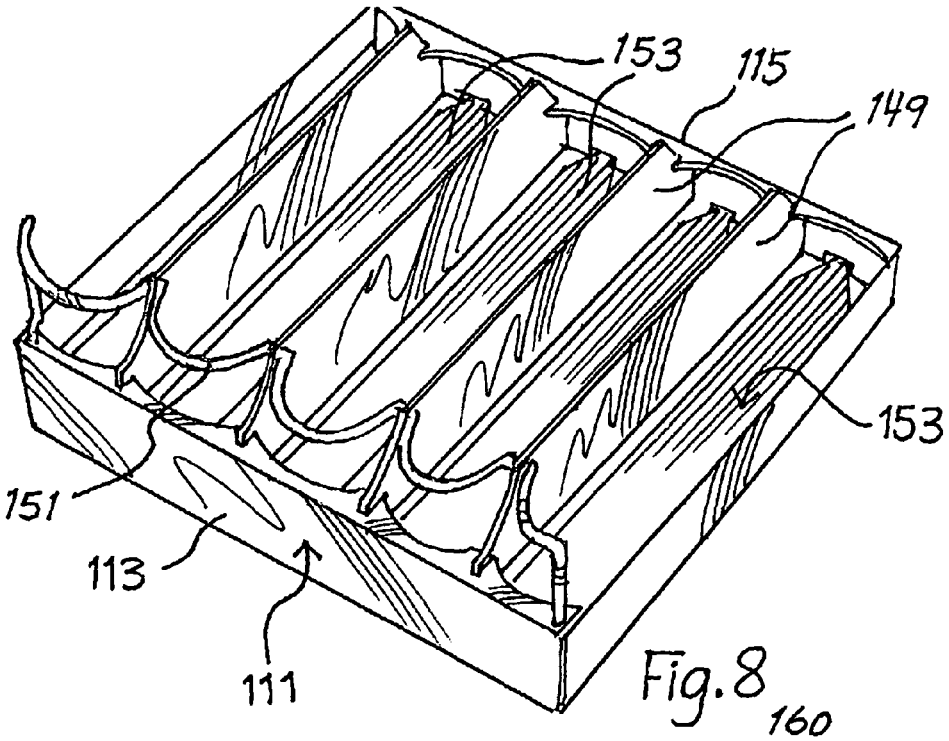

FIG. 8 shows a shelf 111 according to one embodiment of the shelf assembly 101. The shelf 111 has a front edge 113 and a rear edge 115. Partitions 149, in the form of upright sheets, which extend between the front edges 113, 115 of the shelf, are arranged on the shelf 111. The partitions 149 are arranged parallel to and at a distance from each other and form channels which usually hold one product in their transverse direction. A slide coating is arranged on the bottom of each channel, that is on the upper side of the shelf 111. The slide coating can be, for instance, a strip or an entire mat of a material of a particularly low friction, or a low friction paint which is applied on the upper side of the shelf 111. At the front edge 113 of the shelf 111, a guard, for instance a wire yoke, is arranged to prevent the products from falling over the front edge 113.

Figure 10:
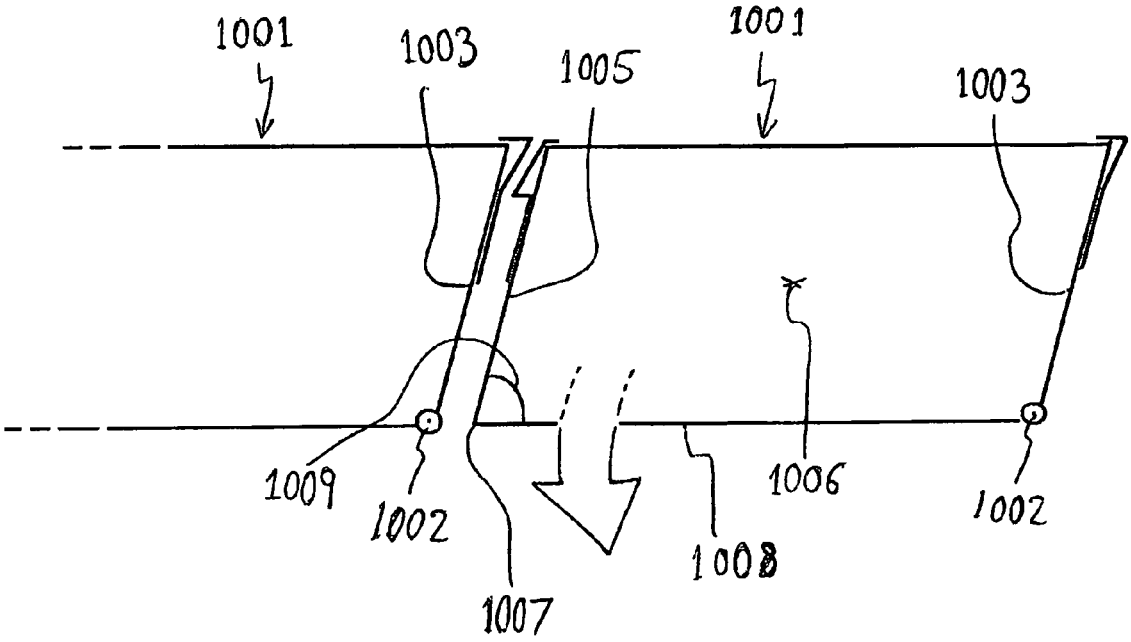
FIG. 10 is a schematic perspective view from above of two shelf assemblies according to an alternative embodiment of the shelf assembly.

An alternative embodiment of the shelf assembly 1001 is illustrated in FIG. 10. The figure shows two such shelf assemblies 1001 which are placed side by side and close to each other. This embodiment is an alternative to the shelf assembly with a bevelled rear corner as described above. The shelf assembly 1001 is connected to the position-fixing means at a first front corner 1002, which is located adjacent to a first end wall 1003 of the shelf assembly 1001. The rear corner 1004 which is located adjacent to the second end wall 1005 and which thus is positioned diametrically opposite to the first front corner 1002, is retracted in the lateral direction so that it is located closer to the centre 1006 of the shelving section 1001 than is the second front corner 1007, which is also located adjacent to the second end wall 1005. More specifically, the second end wall 1005 is inclined, that is between the second end wall 1005 and the front 1008 of the shelf assembly 1001 there is an acute angle 1009, not a right angle. At the same time the rear corner 1010 which is located adjacent to the first end wall 1003 is located further away from the centre 1006 than is the first front corner 1002. As a result, a horizontal cross-section of the shelf assembly 1001 is rhombic. The shelf assemblies 1001 are shown in a display position. When one of the shelf assemblies 1010 is pivoted, as indicated by the arrow in the figure, to a refill position, its shape allows it to go free of the neighbouring shelf assembly 1001.

Figure 11:
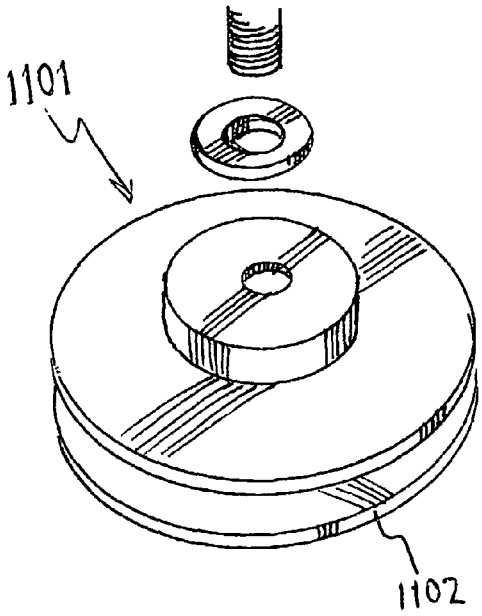
FIGS. 11 and 12 are schematic perspective and side views of an alternative embodiment of part of the shelf assembly.
Figure 12:
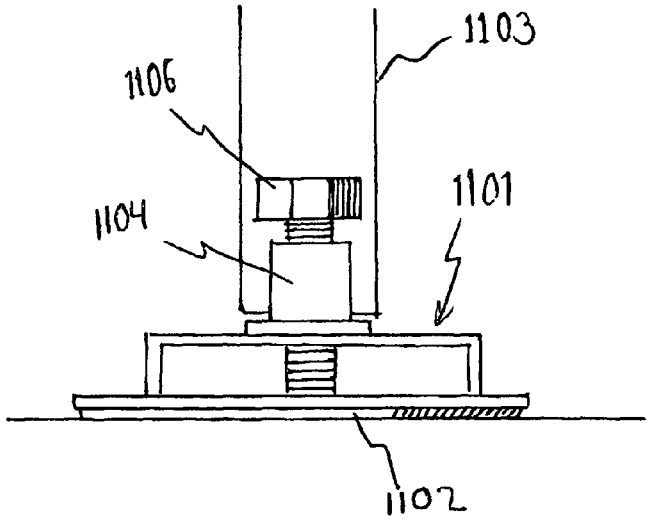

FIGS. 11 and 12 illustrate an alternative embodiment of a position-fixing means 1101. It has a circular abutment surface 1102 against the base and has a main extent along the base. A portion 1103 of the shelving section is provided with a first connecting means 1104 and the position-fixing means 1101 is provided with a second connecting means 1005 which is pivotally connected to the first connecting means 1104. A weight-distributing means 1106 is also arranged and comprises a screw means 1106 for vertical adjustment.

The invention has been described above and exemplified by way of embodiments. However, many modification and alternatives are within the scope of the invention, as will be appreciated by a person skilled in the art. Below follow some examples of alternative embodiments.

In one alternative embodiment of the floor frame, it is provided with a whole rectangular sheet, the length and width of which correspond to the lengths of the legs. This means that one or more of the wheels of the shelving section stand on the sheet in any case in the display position. The entire sheet can be provided with high friction material on its underside.

Within the scope of the invention there are also embodiments where the engagement of the floor frame with the base is fixed securing to the floor or to a neighbouring wall by means of screws or the like. Such fixed securing can also be combined with the frictional engagement. It is, however, often desirable to avoid engagement in the surface layers, and therefore it is advantageous to use only frictional engagement.

The invention claimed is:

1. A shelf assembly for products, comprising a shelving section which has a plurality of gravity-feeding shelves and a base plate, the underside of which is provided with roller means, which are adapted to roll on a base; and a position-fixing means which extends along the base and which is arranged to engage the base, the shelving section being pivotally connected to the position-fixing means and being pivotable between at least one display position, in which the shelves are accessible from the front of the shelving section, and a refill position, in which the shelves are accessible from the rear of the shelving section, wherein the shelving section is provided with a first connecting means and the position-fixing means is provided with a second, complementary connecting means, the connecting means being pivotally connected to each other, and at least one of the connecting means being provided with a weight-distributing means for adjusting how much of the weight of the shelving section acts on the connecting means.

2. The shelf assembly as claimed in claim 1, wherein said weight-distributing means comprises a height-adjusting means for adjusting the distance of the base plate to the base adjacent to said connecting means.

3. A shelf assembly for products, comprising a shelving section which has a plurality of gravity-feeding shelves and a base plate, the underside of which is provided with roller means, which are adapted to roll on a base; and a position-fixing means which extends along the base and which is arranged to engage the base;

the shelving section having a front and a rear, a first and a second end wall, and front and rear corners respectively, the shelving section being pivotally connected to the position-fixing means at the one of the front corners which is located adjacent to the first end wall, and being pivotable between at least one display position, in which the shelves are accessible from the front of the shelving section, and a refill position, in which the shelves are accessible from the rear of the shelving section, the shelving section being designed so as to be pivotable also when the shelf assembly is positioned between two other, neighbouring shelf assemblies, the rear corner located adjacent to the second end wall being positioned closer to the centre of the shelving section than the front corner located adjacent to the same end wall, wherein the shelving section is provided with a first connecting means and the position-fixing means is provided with a second, complementary connecting means, the connecting means being pivotally connected to each other, and at least one of the connecting means being provided with a weight-distributing means for adjusting how much of the weight of the shelving section acts on the connecting means.

4. The shelf assembly as claimed in claim 3, wherein said weight-distributing means comprises a height-adjusting means for adjusting the distance of the base plate to the base adjacent to said connecting means.

5. The shelf assembly as claimed in claim 1, wherein said position-fixing means on its side facing the base is provided with a high friction material, and the high friction material is a rubber tape.

6. The shelf assembly as claimed in claim 1, wherein the position-fixing means is L-shaped.

7. The shelf assembly as claimed in claim 3, wherein the position-fixing means on its side facing the base is provided with a high friction material, which causes frictional engagement with the base.

8. The shelf assembly as claimed in claim 4, wherein the position-fixing means on its side facing the base is provided with a high friction material, which causes frictional engagement with the base.

* * * * *